US012601169B2

(12) United States Patent
Torres et al.

(10) Patent No.: US 12,601,169 B2
(45) Date of Patent: Apr. 14, 2026

(54) MID-WALL VENT AND SYSTEMS INCORPORATING THE SAME

(71) Applicant: Stockton Products, North Las Vegas, NV (US)

(72) Inventors: Angelberto Torres, La Puente, CA (US); Thomas Arthur Anderberg, Oakland, CA (US); Don Pilz, Livermore, CA (US)

(73) Assignee: STOCKTON PRODUCTS, Las Vegas, NV (US)

( * ) Notice: Subject to any disclaimer, the term of this patent is extended or adjusted under 35 U.S.C. 154(b) by 518 days.

(21) Appl. No.: 18/046,884

(22) Filed: Oct. 14, 2022

(65) Prior Publication Data

US 2023/0120594 A1 Apr. 20, 2023

Related U.S. Application Data

(60) Provisional application No. 63/256,502, filed on Oct. 15, 2021.

(51) Int. Cl.
*E04B 1/70* (2006.01)

(52) U.S. Cl.
CPC ..... *E04B 1/7076* (2013.01); *E04B 1/7038* (2013.01)

(58) Field of Classification Search
CPC ..... E04B 1/70; E04B 1/7038; E04B 1/7053; E04B 1/7069; E04B 1/7076; E04B 1/765; E04B 1/665; E04B 1/68; E04B 1/6803; E04B 1/3806; E04B 1/6807; E04F 13/007; E04F 13/06; E04F 2019/0445; E04D 13/152
See application file for complete search history.

(56) References Cited

U.S. PATENT DOCUMENTS

| | | | | |
|---|---|---|---|---|
| 2,974,448 | A * | 3/1961 | Weis | E04D 13/1415 52/60 |
| 4,391,074 | A | 7/1983 | Holsman | |
| 5,630,297 | A | 5/1997 | Rutherford | |
| 6,385,932 | B1 | 5/2002 | Melchiori | |
| 8,082,713 | B2 | 12/2011 | Matthews | |
| 8,468,750 | B2 * | 6/2013 | Clearfield | E04B 2/707 52/60 |
| 9,194,171 | B2 * | 11/2015 | Norwood | E06B 1/68 |
| 10,024,063 | B2 | 7/2018 | Friel | |
| 10,196,812 | B1 * | 2/2019 | Duffy | E04F 13/007 |
| 10,494,818 | B2 * | 12/2019 | Maziarz | E06B 7/2303 |
| 10,533,324 | B2 * | 1/2020 | Baltz, Jr. | E04B 1/7076 |
| 10,655,336 | B2 * | 5/2020 | Friel | E04B 1/70 |
| 10,731,335 | B2 | 8/2020 | Baltz, Jr. et al. | |
| 10,753,083 | B2 | 8/2020 | Baltz, Jr. et al. | |
| D896,993 | S | 9/2020 | Baltz, Jr. et al. | |

(Continued)

*Primary Examiner* — Brian E Glessner
(74) *Attorney, Agent, or Firm* — Womble Bond Dickinson (US) LLP

(57) ABSTRACT

A vent member includes a first member and a second member. The first member includes a first portion, a second portion offset from the first portion and a first transverse panel extending transversely from the second portion. The second member includes a third portion for being received behind the second portion of the first member, a fourth portion extending below the third portion, a second transverse panel, and a third transverse panel above the second transverse panel. The vent member may be mounted over upper and lower walls.

20 Claims, 3 Drawing Sheets

(56) References Cited

U.S. PATENT DOCUMENTS

| | | | | |
|---|---|---|---|---|
| D904,649 | S | 12/2020 | Maldonado et al. | |
| 11,613,889 | B2 * | 3/2023 | Preston | E04F 13/06 52/169.5 |
| 12,221,791 | B2 * | 2/2025 | Honore, III | E04F 13/06 |
| 2008/0016808 | A1 * | 1/2008 | Pilz | E04F 13/06 52/302.6 |
| 2017/0254091 | A1 * | 9/2017 | Friel | E04F 19/02 |
| 2022/0098872 | A1 * | 3/2022 | Albracht | E04F 13/12 |

* cited by examiner

MID-WALL VENT AND SYSTEMS INCORPORATING THE SAME

CROSS-REFERENCE TO RELATED APPLICATION

This application is based upon and claims priority of U.S. Provisional Application No. 63/256,502 filed Oct. 15, 2021, the contents of which are fully incorporated herein by reference.

BACKGROUND

Stucco, plaster or other claddings are typically used for exterior surfaces of building structures defining substrates such as walls. Such claddings are applied over a wire mesh over felt paper which has been attached to underlying substrate, e.g. wall. This method of cladding installation often results in leak problems between the cladding and the substrate and often results in the collection of moisture between the cladding and substrate.

Weep screeds are often used with claddings over walls towards a bottom end of the wall or mid-wall (as for example externally between an upper and a lower wall between floors) to act as a stop for the cladding applied to the wall. Weep screeds generally have a panel that abuts the wall and a leg that extends transversely outward to provide a surface for the cladding to contact. A weep screed also allows moisture to be collected between the cladding and the substrate to drain. However, better drainage systems are desired that can be used mid-wall (e.g., between an upper and a lower wall) that allow for proper venting of the moisture and thus, alleviate leak problems.

SUMMARY

In an example embodiment a vent member includes a first member and a second member. The first member includes a first portion, a second portion offset from the first portion and extending below the first portion, a lip extending from a lower end of the first portion to an upper end of the second portion, and a first transverse panel extending transversely from the second portion. The second member includes a third portion for being received behind the second portion of the first member, a fourth portion extending below the third portion, a second transverse panel, and a third transverse panel above the second transverse panel. In another example embodiment, the first transverse panel includes at least a one first opening therethrough, and the second transverse panel includes at least one second opening therethrough. In yet another example embodiment, the first transverse panel includes a first shelf portion and a first distal portion extending from the first shelf portion, and the at least one first opening is formed through the first shelf portion. The second transverse panel includes a second shelf portion and a second distal portion extending from the second shelf portion, and the at least one second opening is formed through the second shelf portion. In a further example embodiment, either or both the first member and the second member are each formed from a single piece of material. In yet a further example embodiment, each of the third transverse panel, the first distal portion, and the second distal portion extend obliquely downward.

In another example embodiment, a vent system includes a vent member. The vent member includes a first member and a second member. The first member includes a first portion, a second portion offset from the first portion and extending below the first portion, a lip extending from a lower end of the first portion to an upper end of the second portion, and a first transverse panel extending transversely from the second portion and including at least one first opening formed therethrough. The second member includes a third portion received behind the second portion of the first member, a fourth portion extending below the third portion, a second transverse panel including at least one second opening formed therethrough, and a third transverse panel above the second transverse panel. The vent system also includes a first drainage mat over the first member and above the first transverse panel. The first drainage mat has a lower end aligned with the at least one first opening for allowing for any moisture within the first drainage mat to drain through the at least one first opening. The vent system also includes a second drainage mat over the second member and below the second transverse panel, the second drainage mat has an upper end aligned with the at least one second opening for allowing for any moisture within the second drainage mat to vent through the at least one second opening. In yet another example embodiment, the first transverse panel includes a first shelf portion and a first distal portion extending from the first shelf portion, the at least one first opening is formed through the first shelf portion, and the lower end of the first drainage mat is aligned with the first shelf portion. The second transverse panel includes a second shelf portion and a second distal portion extending from the second shelf portion, the at least one second opening is formed through the second shelf portion, and the upper end of the second drainage mat is aligned with the second shelf portion. In yet another example embodiment, the vent system includes a first substrate and a second substrate below and spaced apart from the first substrate and defining a gap therebetween. With this embodiment, the first member is connected over and to the first substrate, and the second member is connected over and to the second substrate and extends over the gap. In a further example embodiment, the vent system includes a first water resistive barrier over the first portion of the first member, a first flashing over the first water resistive layer, a second water resistive barrier over the second substrate, and a second flashing extending over the first substrate and beneath the second portion of the first member, extending over the gap and over the second water resistive barrier, such that the second water resistive barrier and a portion of the second flashing are sandwiched between the second member and the second substrate. In yet a further example embodiment, the vent system includes a first water resistive barrier and a first flashing sandwiched between the first portion of the first member and the first substrate, and a second water resistive barrier and a second flashing sandwiched between the first portion of the second member and the second substrate. In another example embodiment, a portion of the second flashing extends over the gap. In yet another example embodiment, another portion of the second flashing is sandwiched between the second portion of the first member and the first substrate. In one example embodiment, the vent system includes a first water resistant barrier and a first flashing over the first substrate, and a second water resistant barrier and a second flashing over the second substrate. In another example embodiment, the second flashing extends over the gap and over the first substrate. In yet another example embodiment, either or both the first member and the second member are each formed from a single piece of material. In a further example embodiment, each of the third transverse panel, the first distal portion, and the second distal portion extend obliquely downward. In yet a further example embodiment, the first substrate is mounted on a first wall and the second substrate is mounted on a second wall below the first wall and a floor is located between the first and second walls. In one example embodiment, the first substrate extends over the floor. 19. In another example embodiment, the vent system includes a water resistive barrier and a flashing between the first member and the first substrate and between the second member and the second substrate. In a further example embodiment, a substrate extends over a first wall and over a second wall below the first wall and is sandwiched between the first member and the first wall and between the second member and the second wall.

DESCRIPTION

Figure 1:
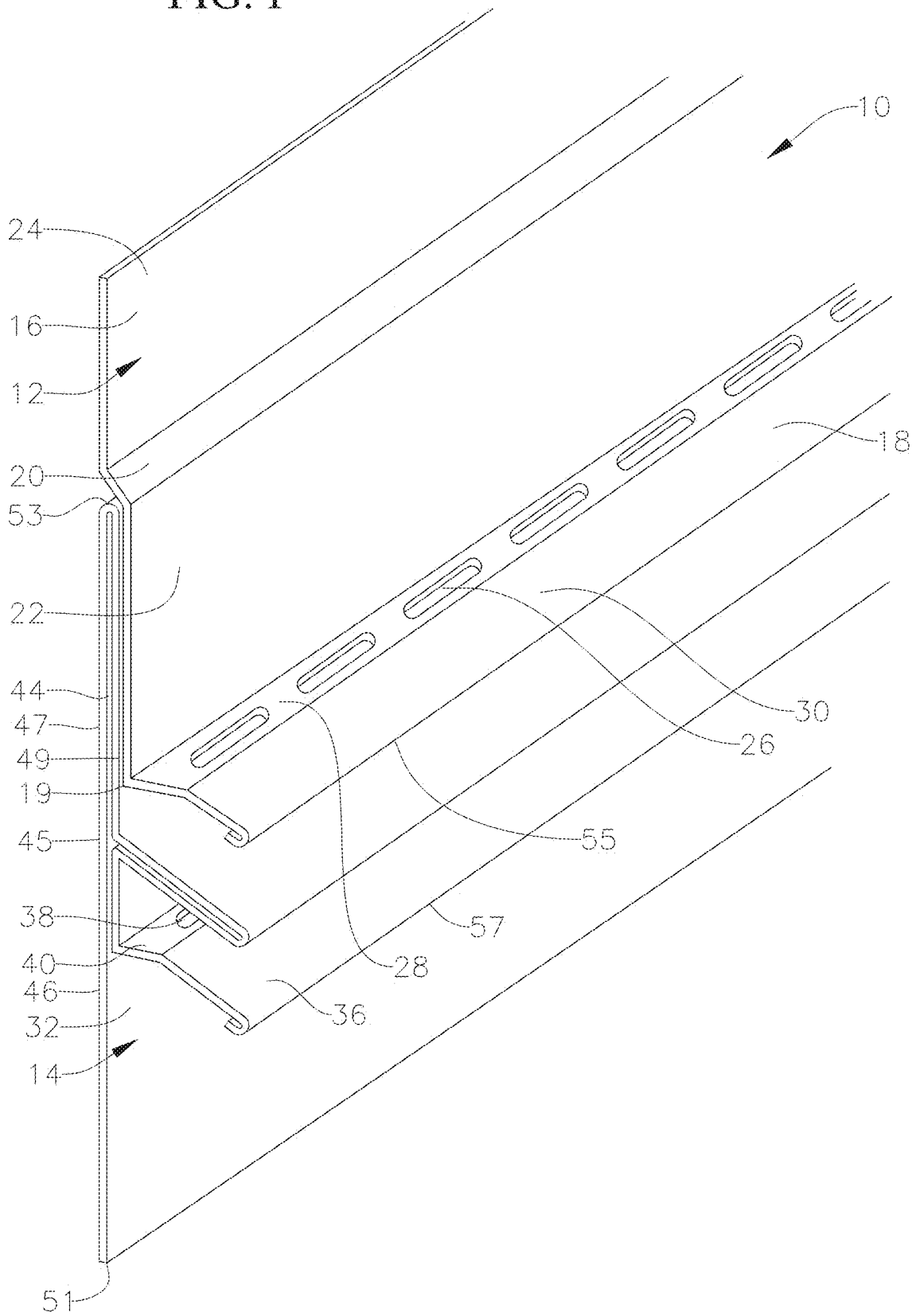
FIG. 1 is a perspective view of an example embodiment mid-wall vent.

A mid-wall vent 10 includes an upper member 12 and a lower member 14 slidable relative to the upper member, as for example shown in FIG. 1. The upper member includes a base panel 16 from which extends a transverse panel 18. The base panel 16 is joggled forming a lip 20 such that a lower portion 22 of the base panel is offset from an upper portion 24 of the base panel. The transverse panel 18 extends from a lower portion or a lower end of the base panel lower portion. In one example embodiment, the transverse panel 18 extends obliquely downward from the lower portion 22 of the base panel. In the example embodiment as shown in FIG. 1, the transverse panel 18 extends from a distal end 19 of the lower panel 22 of the base panel. At least one opening 26 is formed through the transverse panel. In the example embodiment shown in FIG. 1, the transverse panel includes a shelf portion 28 extending from the base panel and a second portion 30 extending obliquely downward and distally from the shelf portion. With this embodiment, the at least one opening 26 is formed through the shelf portion. In an example embodiment, the at least one opening is a plurality of slots, as shown in FIG. 1. In an example embodiment, the base panel and transverse panel of the upper member may be separately formed and connected. In the example embodiment shown in FIG. 1, the base panel and the transverse panel are integrally formed from a single piece or layer of material.

The lower member 14 includes a base panel 32 from which extend an upper transverse panel 34 and a lower transverse panel 36 below the upper transverse panel 34. At least one opening 38 is formed through the lower transverse panel 36. In the example embodiment, the upper transverse panel extends obliquely downward from the lower member base panel 14. The lower member base panel 32 has an upper portion 44 that extends above the upper transverse panel 34 and a lower portion 46 that extends below the lower transverse panel 36. In an example embodiment, the lower transverse panel 36 includes a shelf portion 40 from which extends a second distal portion 42. In an example embodiment, the second distal portion 42 extends obliquely downward from the shelf portion 40 as shown in FIG. 1. With this embodiment, at least one opening 38 formed through the lower transverse panel 36 is formed through the shelf portion 40. In an example embodiment, the at least one opening 38 is a plurality of slots.

The upper portion 44 of the lower member base panel is received behind the offset lower portion 22 of the upper member base panel. The upper portion 44 of the lower member and the lower portion 22 of the upper member can slide relative to each other to a desired position. In an example embodiment, any of the base panel, the upper transverse panel and the lower transverse panel of the lower member may be individual panels that are connected together. In the example embodiment, shown in FIG. 1, the lower member base panel, upper transverse panel, and lower transverse panel are integrally formed from a single piece of sheet material 45. The sheet material is folded over itself to define a first portion 47 and a second portion 49 over the first portion. A portion of the second portion 49 of the lower base panel is folded over itself to define the upper transverse panel 34. The lower transverse panel 36 is formed from a distal end portion of the second portion 49 of the sheet material. The first portion 47 of the sheet material defines the lower end 51 and the upper end 53 of the lower member base panel. In an example embodiment, the distal end 55 of the transverse panel 18 and the distal end 57 of the lower transverse panel 36 formed by bending an end portion of the material folding such panels onto themselves so as to create distal ends that are rounded.

Figure 2:
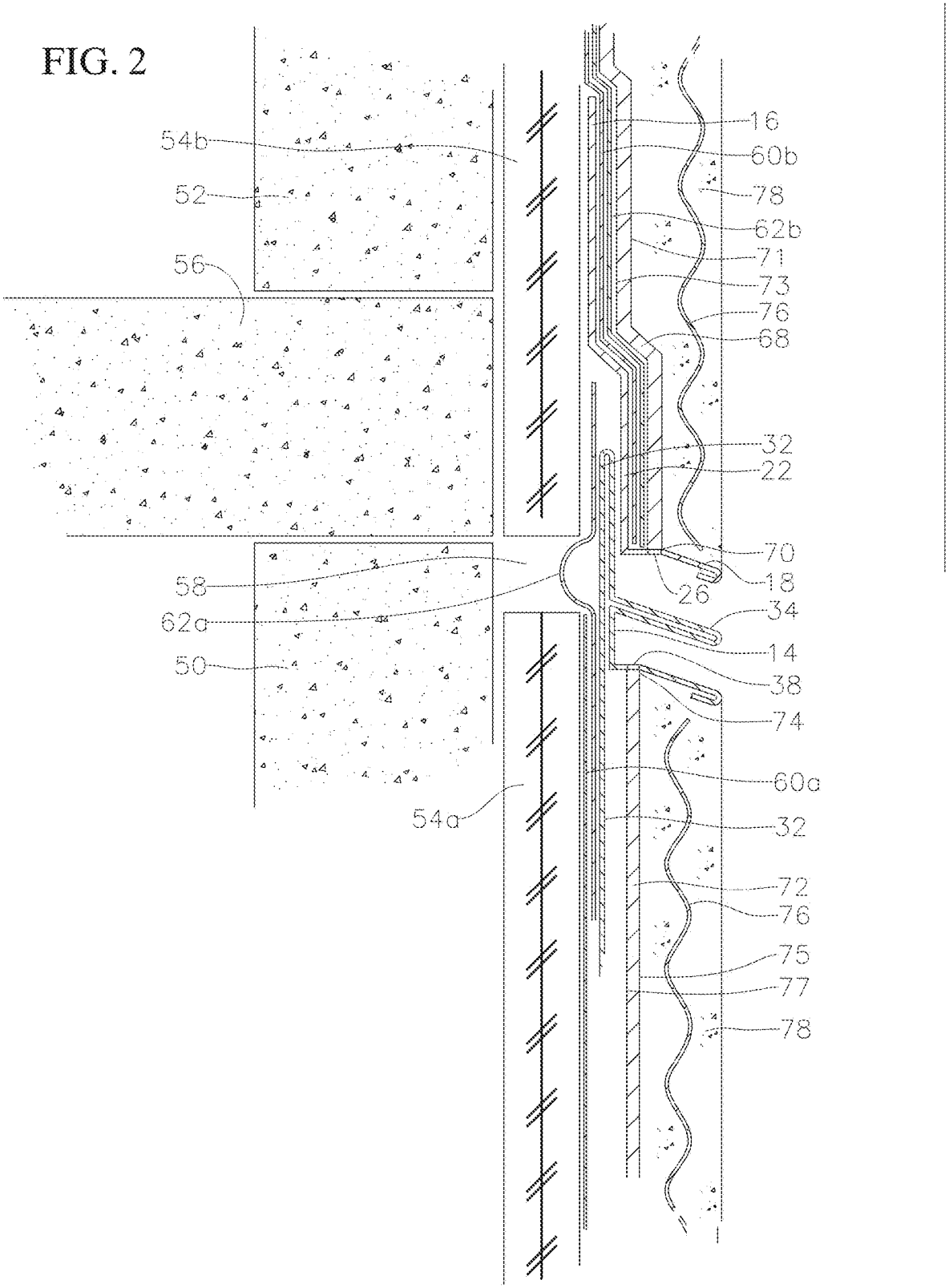
FIG. 2 is a cross-sectional view of a mid-wall vent system mounted to upper and lower walls of a building structure.

In an example embodiment as shown in FIG. 2, the mid-wall vent is installed mid-wall as for example between a lower wall, such as a first floor wall 50, and an upper wall above the lower wall such as a second floor wall 52. However, the mid-wall vent may be installed mid-wall between any two vertically adjacent walls. A first sheathing (or other substrate) 54*a* may be placed over the first floor wall 50 and a second sheathing (or other substrate) 54*b* is placed over the second floor wall 52 as well as over a floor 56 between the two walls. A gap 58 may be provided between the first sheathing 54*a* over the first floor wall and the second sheathing 54*b* over the second floor wall. The base panel 16 of the upper member is placed over and connected to the second sheathing 54*b* over the second floor wall 52, such that the lower portion 22 of the upper member extends over a portion of the gap 58. A second water resistant barrier 60*b* is placed over the base panel 16 of the upper member and over the second sheathing 54*b* extending above the base panel 16 of the upper member. A first water resistant barrier 60*a* is placed over the first sheathing 54*a* of the first floor. In an example embodiment, the water resistive barriers are layers or film type materials that resist penetration by water or moisture. Moisture may be in the form of vapor. Water resistive barriers are well known in the art. They are often barrier films or layers which resist penetration by water, moisture, or vapor. A second flashing 62*b*, such as self-adhesive flashing (which in an example embodiment is a layer material), is placed over the second water resistant barrier 60*b*, the base panel 16 of the upper member and over the second sheathing 54*b* extending above the base panel 16 of the upper member. A first flashing 62*a*, such as a self-adhesive flashing (which in an example embodiment is a layer material), is placed over the second sheathing 54*b* over the upper wall and beneath the lower portion 22 of the upper member and extending over the gap 58 and over the first sheathing 54*a* and the first water resistant barrier 60*a* over the first floor. In an example embodiment, the first flashing 62*a* is placed in position prior to the mounting of the base panel 16 of the upper member to the sheathing 54. The base panel 32 of the lower member 14 is slid behind the offset lower portion 22 of the upper member base panel and over the first flashing 62*a* such that the upper transverse panel 34 is spaced below the upper member transverse panel 18. The lower member base panel 32 is then connected to the first sheathing 54*a* such that the first water resistant barrier 60*a* and the first flashing 62*a* are sandwiched between the lower member base panel 32 and the first sheathing 54*a*. In the shown example embodiment, the transverse panel 18 and the upper transverse panel 34 extend from locations at levels within the gap 58. An upper drainage mat 68 is placed over the second flashing 62*b*, the second water resistant barrier 60*b* and the upper member base panel 16 and over the sheathing 54 over second floor wall. The lower end 70 of the upper drainage mat is aligned with the at least one opening 26 formed though the transverse panel 18. The upper end of the upper drainage mat 68 may extend to a top vent member (not shown). A lower drainage mat 72 is placed over the base panel 32 of the lower member and over the first floor wall, the first flashing 62*a*, the first water resistant barrier 60*a* and the first sheathing 54*a*. An upper end 74 of the lower drainage mat 72 is aligned with the at least one opening 38 formed on the lower transverse panel 36. In this regard, moisture collected within the upper drainage mat can drain downward through the lower end 70 of the upper drainage mat and through the at least one opening 26, while moisture collected within the lower drainage mat 72 is vented upward through the upper end 74 of the lower drainage mat and through the at least one opening 38 formed through the lower transverse panel 36. "Drainage mat" as used herein refers to any type of structure can cover a surface area and is capable of absorbing and draining moisture. In an example embodiment, the drainage mat has a first surface 71, 75 opposite a second surface 73, 77 and a thickness therebetween. The first surface 71, 75 defining an outer surface of the mat furthest from its corresponding vent member base panel allows for moisture to enter the drainage mat but resists the drainage of the moisture through such surface. In this regard, the moisture will take the path of least resistance and drain/exit through an end, such as end 70 or 74 of such drainage mat. A lath 76 may be placed over each of the drainage mats. A cladding 78, such as stucco, plaster, wood or other siding may be placed over the lath.

Figure 3:
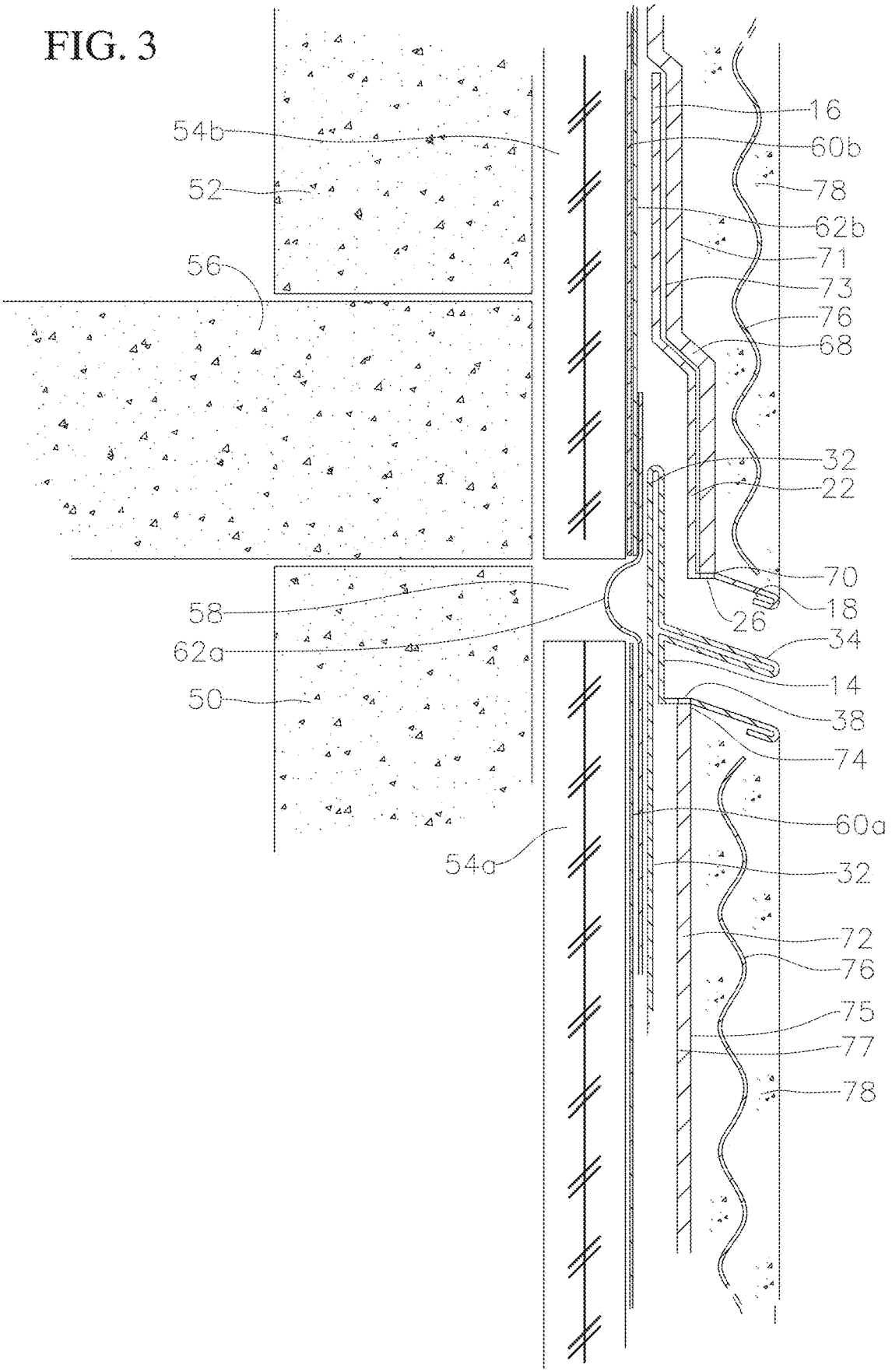
FIG. 3 is a cross-sectional view of another example embodiment mid-wall vent system mounted to upper and lower walls of a building structure.

In another example embodiment, the water resistive barrier 60*b* is placed over the second sheathing 54*b* over the second floor wall, and the second flashing 62*b* is placed over the water resistive barrier 60*b*. The base panel 16 of upper member is then mounted over the second flashing 62*b*, as for example shown in FIG. 3.

In another example embodiment, a single water resistive layer and a single flashing are placed over both sheathing members or over a single sheathing member mounted over both the upper and lower walls and the floor therebetween. With this embodiment, the vent member first member is mounted over the sheathing, water resistive barrier, and flashing over the upper wall, while the vent member second member is mounted over the sheathing, water resistive barrier, and flashing over the lower wall. In an example embodiment the water resistive barrier is placed over the flashing, while in another example embodiment, the flashing is placed over the water resistive barrier.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Moreover, although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Additionally, as used herein, the term "generally," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" or "over" another component, it can be directly on or over the other component, or components may also be present therebetween. Moreover, when a component is component is referred to as being "coupled" to another component, it can be directly attached to the other component or intervening components may be present therebetween. In addition, the terms "first", "second", and "third" when referring to components are just labels for distinguishing such components from each other and are not the generic names of such components. For example, a component described as a "first" component in the specification may be recited in the claims as a "second" component.

The invention claimed is:

1. A vent member comprising:
- a first member comprising,
  - a first portion,
  - a second portion offset from the first portion and extending below the first portion,
  - a lip extending from a lower end of the first portion to an upper end of the second portion, and
  - a first transverse panel extending transversely from the second portion; and
- a second member comprising,
  - a third portion for being received behind the second portion of the first member,
  - a fourth portion extending below the third portion,
  - a second transverse panel, and
  - a third transverse panel above the second transverse panel.

2. The vent member of claim 1, wherein the first transverse panel comprises at least a one first opening therethrough and the second transverse panel comprises at least one second opening therethrough.

3. The vent member of claim 2, wherein the first transverse panel comprises a first shelf portion and a first distal portion extending from the first shelf portion at a first angle, wherein the at least one first opening is formed through the first shelf portion, wherein the second transverse panel comprises a second shelf portion and a second distal portion extending from the second shelf portion at a second angle, and wherein the at least one second opening is formed through the second shelf portion.

4. The vent member of claim 3, wherein the second member is formed from a single sheet of material.

5. The vent member of claim 3, wherein each of the third transverse panel, the first distal portion, and the second distal portion extend obliquely downward.

6. A vent system comprising:
- a vent member comprising,
  - a first member comprising,
    - a first portion, a second portion offset from the first portion and extending below the first portion, a lip extending from a lower end of the first portion to an upper end of the second portion, and a first transverse panel extending transversely from the second portion and comprising at least one first opening formed therethrough, and a second member comprising, a third portion received behind the second portion of the first member, a fourth portion extending below the third portion, a second transverse panel comprising at least one second opening formed therethrough, and a third transverse panel above the second transverse panel;

a first drainage mat over the first member and above the first transverse panel, said first drainage mat having a lower end aligned with the at least one first opening for allowing for any moisture within said first drainage mat to drain through said at least one first opening; and a second drainage mat over the second member and below said second transverse panel, said second drainage mat having an upper end aligned with the at least one second opening for allowing for any moisture within said second drainage mat to vent through said at least one second opening.

7. The vent system of claim 6, wherein the first transverse panel comprises a first shelf portion and a first distal portion extending from the first shelf portion at a first angle, wherein the at least one first opening is formed through said first shelf portion, wherein the lower end of the first drainage mat is aligned with said first shelf portion, wherein the second transverse panel comprises a second shelf portion and a second distal portion extending from the second shelf portion at a second angle, wherein the at least one second opening is formed through the second shelf portion, and wherein the upper end of the second drainage mat is aligned with the second shelf portion.

8. The vent system of claim 6, further comprising:

a first substrate; and a second substrate below and spaced apart from the first substrate and defining a gap therebetween, wherein the first member is connected over and to the first substrate, and wherein the second member is connected to and over the second substrate and extending over the gap.

9. The vent system of claim 8, further comprising:

a first water resistive barrier over the first portion of the first member;

a first flashing over the first water resistive layer;

a second water resistive barrier over the second substrate; and a second flashing extending over the first substrate beneath the second portion of the first member, over the gap and over the second water resistive barrier, wherein the second water resistive barrier and a portion of the second flashing are sandwiched between the second member and the second substrate.

10. The vent system of claim 8, further comprising:

a first water resistive barrier and a first flashing sandwiched between the first portion of the first member and the first substrate; and a second water resistive barrier and a second flashing sandwiched between the first portion of the second member and the second substrate.

11. The vent system of claim 10, wherein a portion of the second flashing extends over the gap.

12. The vent system of claim 11, wherein another portion of the second flashing is sandwiched between the second portion of the first member and the first substrate.

13. The vent system of claim 8, further comprising:

a first water resistant barrier and a first flashing over the first substrate; and a second water resistant barrier and a second flashing over the second substrate.

14. The vent system of claim 13, wherein the second flashing extends over the gap and over the first substrate.

15. The vent system of claim 6, wherein the second member is formed from a single sheet of material.

16. The vent member of claim 6, wherein each of the third transverse panel, the first distal portion, and the second distal portion extend obliquely downward.

17. The vent system of claim 6, wherein the first substrate is mounted on a first wall and the second substrate is mounted on a second wall below the first wall, wherein a floor is located between the first and second walls.

18. The vent system of claim 17, wherein the first substrate extends over the floor.

19. The vent system of claim 17, further comprising a water resistive barrier and a flashing between the first member and the first substrate and between the second member and the second substrate.

20. The vent system of claim 6, further comprising a substrate extending over a first wall and over a second wall below the first wall and sandwiched between the first member and the first wall and between the second member and the second wall.

* * * * *